US007330153B2

(12) United States Patent
Rentz

(10) Patent No.: US 7,330,153 B2
(45) Date of Patent: Feb. 12, 2008

(54) MULTI-BAND INVERTED-L ANTENNA

(75) Inventor: Mark L. Rentz, Torrance, CA (US)

(73) Assignee: Navcom Technology, Inc., Torrance, CA (US)

( * ) Notice: Subject to any disclaimer, the term of this patent is extended or adjusted under 35 U.S.C. 154(b) by 102 days.

(21) Appl. No.: 11/402,141

(22) Filed: Apr. 10, 2006

(65) Prior Publication Data

US 2007/0236400 A1 Oct. 11, 2007

(51) Int. Cl.
*H01Q 1/38* (2006.01)
*H01Q 21/00* (2006.01)

(52) U.S. Cl. ..... 343/700 MS; 343/853

(58) Field of Classification Search ..... 343/700 MS, 343/850, 853, 860, 864, 865; 333/156, 160
See application file for complete search history.

(56) References Cited

U.S. PATENT DOCUMENTS 6,417,806 B1 * 7/2002 Gothard et al. ..... 343/700 MS
6,483,463 B2 * 11/2002 Kadambi et al. .... 343/700 MS
6,856,287 B2 2/2005 Rao et al. ..... 343/700
7,038,626 B2 * 5/2006 Gothard et al. ..... 343/702
7,176,844 B2 * 2/2007 Chiang et al. ..... 343/815

OTHER PUBLICATIONS

Rao, B.R., et al., "Triple Band GPS Trap Loaded Inverted L Antenna Array," Microwave and Opti. Tech. Letters, 2002, http://www.mitre.org/work/tech_papers/tech_papers_02/rao_triband/.

* cited by examiner

*Primary Examiner*—Hoanganh Le
(74) *Attorney, Agent, or Firm*—Morgan, Lewis & Bockius LLP

(57) ABSTRACT

An antenna includes a first antenna element and a second antenna element. The first antenna element and the second antenna element are configured to transmit and receive signals in a first band of frequencies and in a second band of frequencies. A first pair of delay lines is coupled to the first antenna element and a second pair of delay lines coupled to the second antenna element. A first delay line in the first pair of delay lines and the second pair of delay lines is configured to phase shift electrical signals coupled to the first antenna element and the second antenna element such that a first impedance of the antenna is approximately equal in the first band of frequencies and the second band of frequencies. A second delay line in the first pair of delay lines and the second pair of delay lines is configured to convert the first impedance to a second impedance.

21 Claims, 10 Drawing Sheets

MULTI-BAND INVERTED-L ANTENNA

FIELD OF THE INVENTION

The present invention relates generally to multi-band antennas, and more specifically, to multi-band inverted-L antennas for use in global satellite positioning systems.

BACKGROUND OF THE INVENTION

Receivers in global navigation satellite systems (GNSS's), such as the Global Positioning System (GPS), use range measurements that are based on line-of-sight signals broadcast by satellites. The receivers measure the time-of-arrival of one or more of the broadcast signals. This time-of-arrival measurement includes a time measurement based upon a coarse acquisition coded portion of a signal, called pseudo-range, and a phase measurement.

In GPS, signals broadcast by the satellites have frequencies that are in one or several frequency bands, including an L1 band (1565 to 1585 MHz), an L2 band (1217 to 1237 MHz), an L5 band (1164 to 1189 MHz) and L-band communications (1520 to 1560 MHz). Other GNSS's broadcast signals in similar frequency bands. In order to receive one or more of the broadcast signals, receivers in GNSS's often have multiple antennas corresponding to the frequency bands of the signals broadcast by the satellites. Multiple antennas, and the related front-end electronics, add to the complexity and expense of receivers in GNSS's. In addition, the use of multiple antennas that are physically displaced with respect to one another may degrade the accuracy of the range measurements, and thus the position fix, determined by the receiver.

There is a need, therefore, for improved antennas for use in receivers in GNSS's to address the problems associated with existing antennas.

SUMMARY

Embodiments of a multi-band antenna are described. In some embodiments, the antenna includes a first antenna element and a second antenna element. The first antenna element and the second antenna element are configured to transmit and receive signals in a first band of frequencies and in a second band of frequencies. Frequencies in the second band of frequencies are greater than frequencies in the first band of frequencies. A first pair of delay lines, connected in series, is coupled to the first antenna element and a second pair of delay lines, connected in series, is coupled to the second antenna element. A first delay line in the first pair of delay lines and the second pair of delay lines is configured to phase shift electrical signals coupled to the first antenna element and the second antenna element such that a first impedance of the antenna is approximately equal in the first band of frequencies and the second band of frequencies. A second delay line in the first pair of delay lines and the second pair of delay lines is configured to convert the first impedance to a second impedance.

In an exemplary embodiment, the second impedance is 50 Ω, or approximately 50 Ω.

The antenna may include a first resonance circuit coupled to the first antenna element and a second resonance circuit coupled to the second antenna element. The first resonance circuit and the second resonance circuit are configured to each have an impedance greater than a predetermined value in the second band of frequencies such that electrical signals corresponding to the first band of frequencies are coupled to and from the first antenna element and the second antenna element and electrical signals corresponding to the second band of frequencies are substantially coupled to and from a portion of the first antenna element and a portion of the second antenna element.

A central frequency in the second band of frequencies may be approximately 5/4 times a central frequency in the first band of frequencies. Alternately, a central frequency in the second band of frequencies may be approximately 1.29 times a central frequency in the first band of frequencies.

The second delay line in the first pair of delay lines and the second pair of delay lines may have an impedance that is approximately a geometric mean of the first impedance and the second impedance.

The first antenna element and the second antenna element may be arranged approximately along a first axis of the antenna.

The first antenna element and the second antenna element each may include a monopole situated above a ground plane. The monopole may include a metal layer deposited on a printed circuit board. The printed circuit board may be suitable for microwave applications. The first antenna and the second antenna may each be inverted L-antennas.

In some embodiments, the monopole is in a plane that is approximately parallel to a plane that includes the ground plane. In some embodiments, the monopole is in a plane that is approximately perpendicular to a plane that includes the ground plane.

In some embodiments, the antenna may include a third antenna element and a fourth antenna element. The third antenna element and the fourth antenna element are configured to transmit and receive signals in the first band of frequencies and in the second band of frequencies. A third pair of delay lines is coupled to the third antenna element and a fourth pair of delay lines is coupled to the fourth antenna element. A third delay line in the third pair of delay lines and the fourth pair of delay lines is configured to phase shift electrical signals coupled to the third antenna element and the fourth antenna element such that the first impedance of the antenna is approximately equal in the first band of frequencies and the second band of frequencies. A fourth delay line in the third pair of delay lines and the fourth pair of delay lines is configured to convert the first impedance to the second impedance.

The antenna may include a third resonance circuit coupled to the third antenna element and a fourth resonance circuit coupled to the fourth antenna element. The third resonance circuit and the fourth resonance circuits are each configured to have an impedance greater than the predetermined value in the second band of frequencies such that electrical signals corresponding to the first band of frequencies are coupled to and from the third antenna element and the fourth antenna element and electrical signals corresponding to the second band of frequencies are substantially coupled to and from a portion of the third antenna element and a portion of the fourth antenna element.

The third antenna element and the fourth antenna element may be arranged substantially along a second axis of the antenna. The first axis and the second axis may be rotated by approximately 90° from one another.

In some embodiments, a feed network circuit is coupled to the first, second, third and fourth antenna elements. The feed network circuit is configured to phase shift the electrical signals coupled to and from the antenna elements such that radiation to or from the antenna is circularly polarized. The circularly polarized radiation to or from the antenna may be right hand circularly polarized or left hand circularly polarized. The feed network circuit may be configured to phase shift the electrical signals coupled to neighboring antenna elements in the antenna by approximately 90°.

The embodiments of the multi-band antenna at least partially overcome the previously described problems with existing antennas.

BRIEF DESCRIPTION OF THE DRAWINGS

Additional objects and features of the invention will be more readily apparent from the following detailed description and appended claims when taken in conjunction with the drawings.

Like reference numerals refer to corresponding parts throughout the several views of the drawings.

DESCRIPTION OF EMBODIMENTS

Reference will now be made in detail to embodiments of the invention, examples of which are illustrated in the accompanying drawings. In the following detailed description, numerous specific details are set forth in order to provide a thorough understanding of the present invention. However, it will be apparent to one of ordinary skill in the art that the present invention may be practiced without these specific details. In other instances, well-known methods, procedures, components, and circuits have not been described in detail so as not to unnecessarily obscure aspects of the present invention.

The multi-band antenna covers a range of frequencies that may be too far apart to be covered using a single existing antenna. In an exemplary embodiment, the multi-band antenna is used to transmit or receive signal in the L1 band (1565 to 1585 MHz), the L2 band (1217 to 1237 MHz), the L5 band (1164 to 1189 MHz) and L-band communications (1520 to 1560 MHz). These four L-bands are treated as two distinct bands of frequencies: a first band of frequencies that ranges from approximately 1164 to 1237 MHz, and a second band of frequencies that ranges from approximately 1520 to 1585 MHz. Approximately center frequencies of these two bands are located at 1200 MHz ($f_1$) and 1552 MHz ($f_2$). These specific frequencies and frequency bands are only exemplary, and other frequencies and frequency bands may be used in other embodiments.

The multi-band antenna is also configured to have substantially constant impedance (sometimes called a common impedance) in the first and the second band of frequencies. These characteristics may allow receivers in GNSS's, such as GPS, to use fewer or even one antenna to receive signals in multiple frequency bands.

While embodiments of a multi-band antenna for GPS are used for as illustrative examples in the discussion that follows, it should be understood that the multi-band antenna may be applied in a variety of applications, including wireless communication, cellular telephony, as well as other GNSS's. While the embodiments of the multi-band antenna take advantage of phase relationships at two frequency bands of interest, the technique describe may be applied broadly to a variety of antenna types and designs for use in different ranges of frequencies.

Figure 1A:
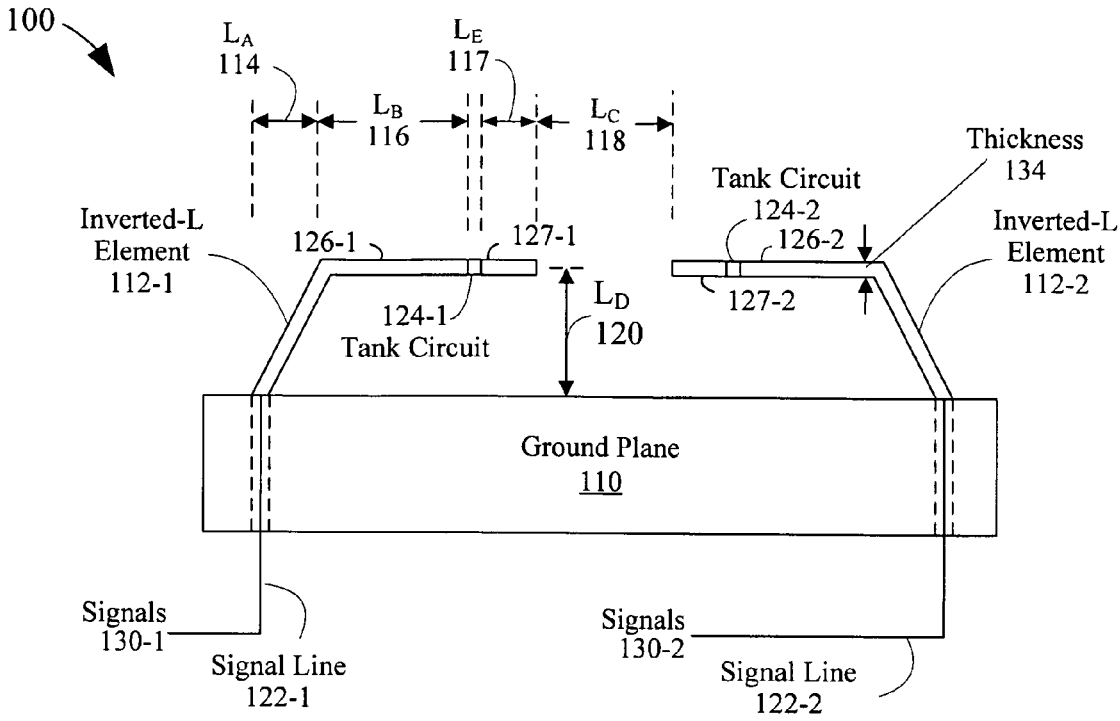
FIG. 1A is a block diagram illustrating a side view of an embodiment of a multi-band antenna.
Figure 1B:
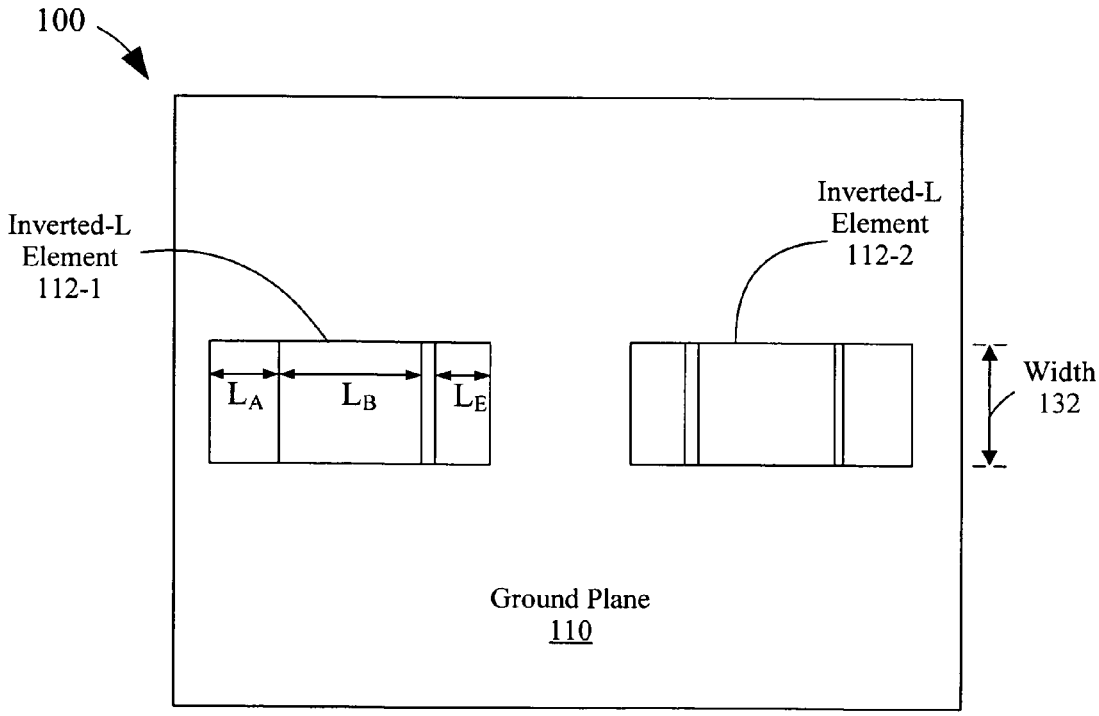
FIG. 1B is a block diagram illustrating a top view of an embodiment of a multi-band antenna.

Attention is now directed towards embodiments of the multi-band antenna. FIGS. 1A and 1B are block diagrams illustrating side and top views of an embodiment of a multi-band antenna 100. The antenna 100 includes a ground plane 110 and two inverted-L elements 112. The inverted-L elements 112 are arranged approximately along a first axis of the antenna 100. Electrical signals 130 are coupled to and from the inverted-L elements using signal lines 122. In some embodiments, the signal lines 122 are coaxial cables and the ground plane 110 is a metal layer (e.g., in or on a printed circuit board) suitable for micro-wave applications.

Each of the inverted-L elements 122 has two segments 126, 127. The first segment 126 (e.g., 126-1 of inverted-L element 112-1), has a length (when projected onto the ground plane 110) of $L_A+L_B$, and the second segment 127 has a length (when projected onto the ground plane 110) of $L_E$. The first and second segments 126, 127 of each inverted-L element 122 are electrically separated from each other by a tank circuit 124 (e.g., tank circuit 124-1 for inverted-L element 122-1).

In a first band of frequencies, the tank circuits 124 have low impedance, and therefore allow electrical signals 130 to be coupled to both segments of the inverted-L elements 112. In a second band of frequencies, however, the tank circuits 124 have high impedance and effectively block the electrical signals 130 from reaching the second segments 127 of the inverted-L elements 122. From another viewpoint, for signals in the first band of frequencies the effective length of each antenna element 122-1, 122-2 is $L_A+L_B+L_E$, while for signals in the second band of frequencies the effective length of each antenna element 122-1, 122-2 is $L_A+L_B$.

In an exemplary embodiment, each instance of the tank circuit 124 may be a parallel inductor and capacitor. The tank circuit 124 is sometimes called a resonance circuit. For example, the tank circuit 124 may exhibit resonance at a center frequency $f_2$ in the second band of frequencies. In this way, the tank circuit 124 may be used to act as a trap for electrical signals 130 in the second band of frequencies.

Each of the inverted-L elements 112, such as inverted-L element 112-1, may have a monopole positioned above the ground plane 110. In the antenna 100, the monopole is in a plane that is approximately parallel to a plane that includes the ground plane 110. The monopole may be implemented using a metal layer deposited on a printed circuit board. The monopole, when operated in the second band of frequencies, may have a length $L_A+L_B$ (114, 116), a thickness 132, a width 134, and may be a length $L_D$ 120 above the ground plane 110. As noted above, when operated in the first band of frequencies, the monopole has a length of $L_A+L_B+L_E$ (114, 116, 117). The two inverted-L elements 112 may be separated by a distance $L_C$ 118. The inverted-L element 112-1 may have a tilted section that has a length projected along the ground plane 110 of $L_A$ 114. This tilted section may alter the radiation pattern of the antenna 100. It does not, however, modify the electrical impedance characteristics of the antenna 100.

Figure 2A:
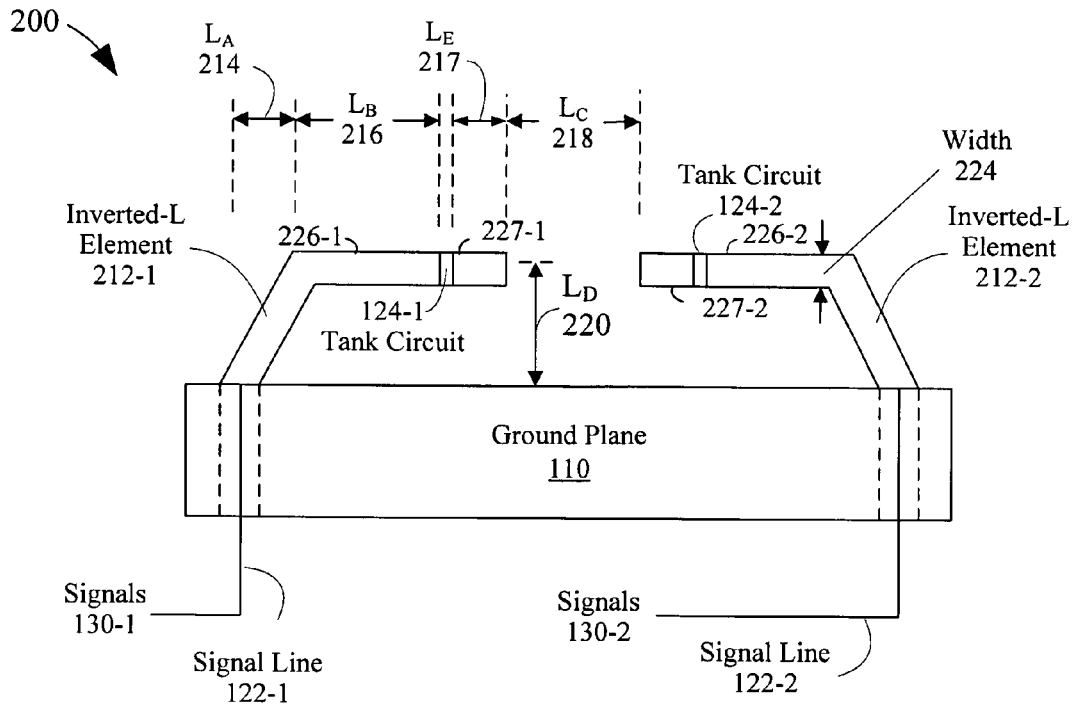
FIG. 2A is a block diagram illustrating a side view of an embodiment of a multi-band antenna.
Figure 2B:
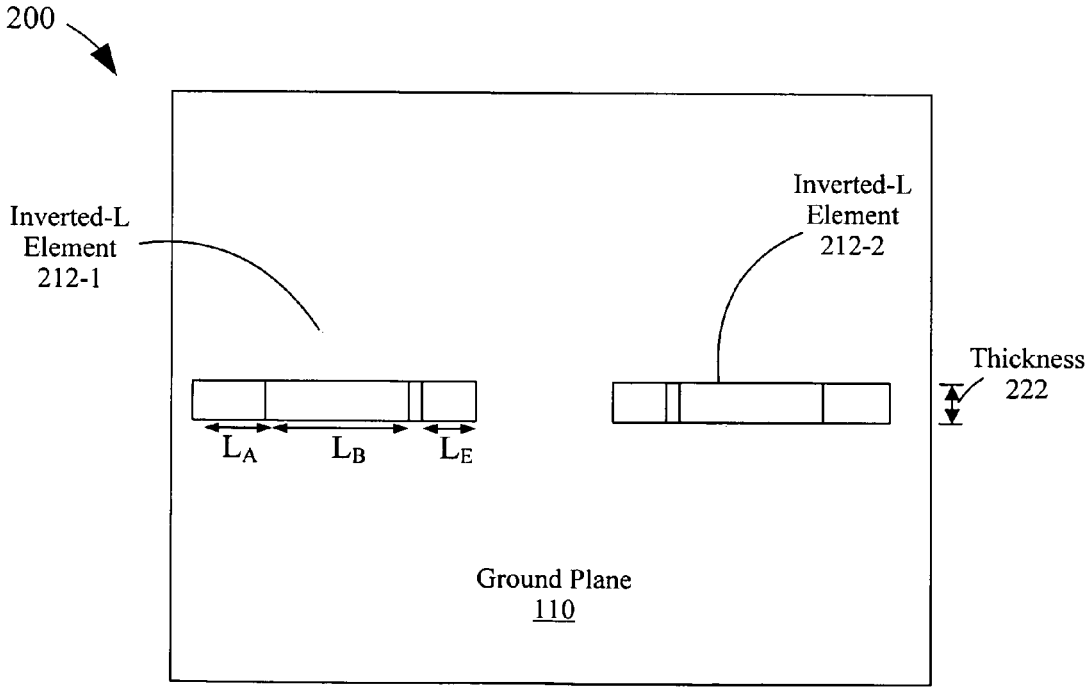
FIG. 2B is a block diagram illustrating a top view of an embodiment of a multi-band antenna.

In some embodiments, the antenna 100 may include additional components or fewer components. Functions of two or more components may be combined. Positions of one or more components may be modified. For example, the monopoles in the inverted-L elements 112 may have alternate geometries. This is shown in FIGS. 2A and 2B, which are block diagrams illustrating side and top views of an embodiment of a multi-band antenna 200. The multi-band antenna 200 is similar to the antenna 100 (FIGS. 1A and 1B) and may have a similar gain pattern and electrical impedance to the antenna 100 (FIGS. 1A and 1B). In the antenna 200, monopoles in inverted-L elements 211 are in a plane that is perpendicular, or approximately perpendicular to the plane that includes the ground plane 110. A respective monopole, such as that in inverted-L element 212-1, may have a length $L_A+L_B+L_E$ (214, 216, 217) when operated in the first band of frequencies, a length of $L_A+L_B$ (214, 216) when operated in the second band of frequencies, a thickness 222, a width 224, and may be a length $L_D$ 220 above the ground plane 110. The two inverted-L elements 212 may be separated by a distance $L_C$ 218. The inverted-L element 212-1 may also have a tilted section that has a length projected along the ground plane 110 of $L_A$ 212. This tilted section may alter the radiation pattern of the antenna 200. It does not, however, modify the electrical impedance characteristics of the antenna 200.

Figure 2C:
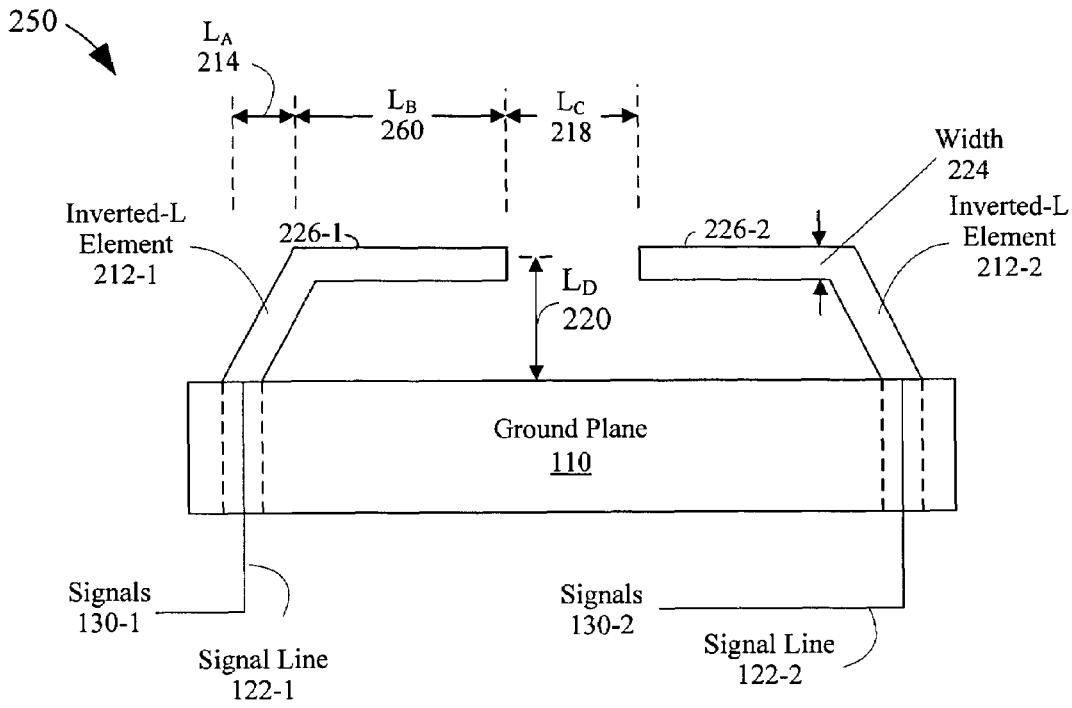
FIG. 2C is a block diagram illustrating a side view of an embodiment of a multi-band antenna.
Figure 2D:
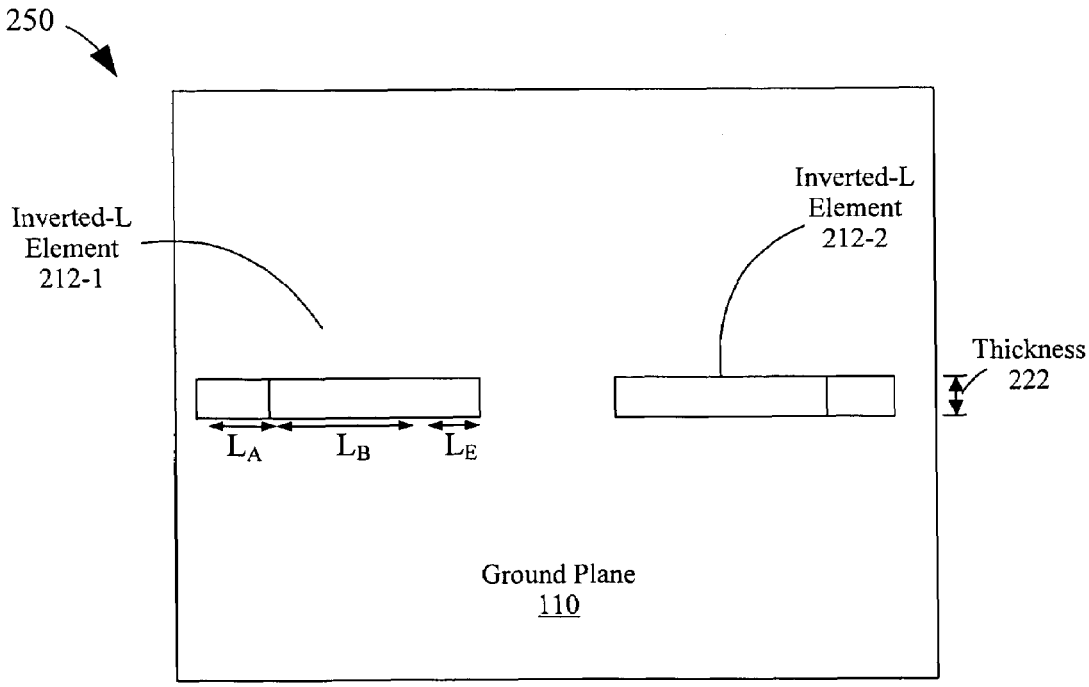
FIG. 2D is a block diagram illustrating a top view of an embodiment of a multi-band antenna.

In some embodiments, the antenna 200 may include additional components or fewer components. For example, FIGS. 2C and 2D illustrate an embodiment 250 without the tank circuit 124. The inverted-L element 212-1, has a fixed or static length $L_A+L_B$ (214, 260) when operated in the first band of frequencies and the second band of frequencies. Functions of two or more components may be combined. Positions of one or more components may be modified.

Figure 3A:
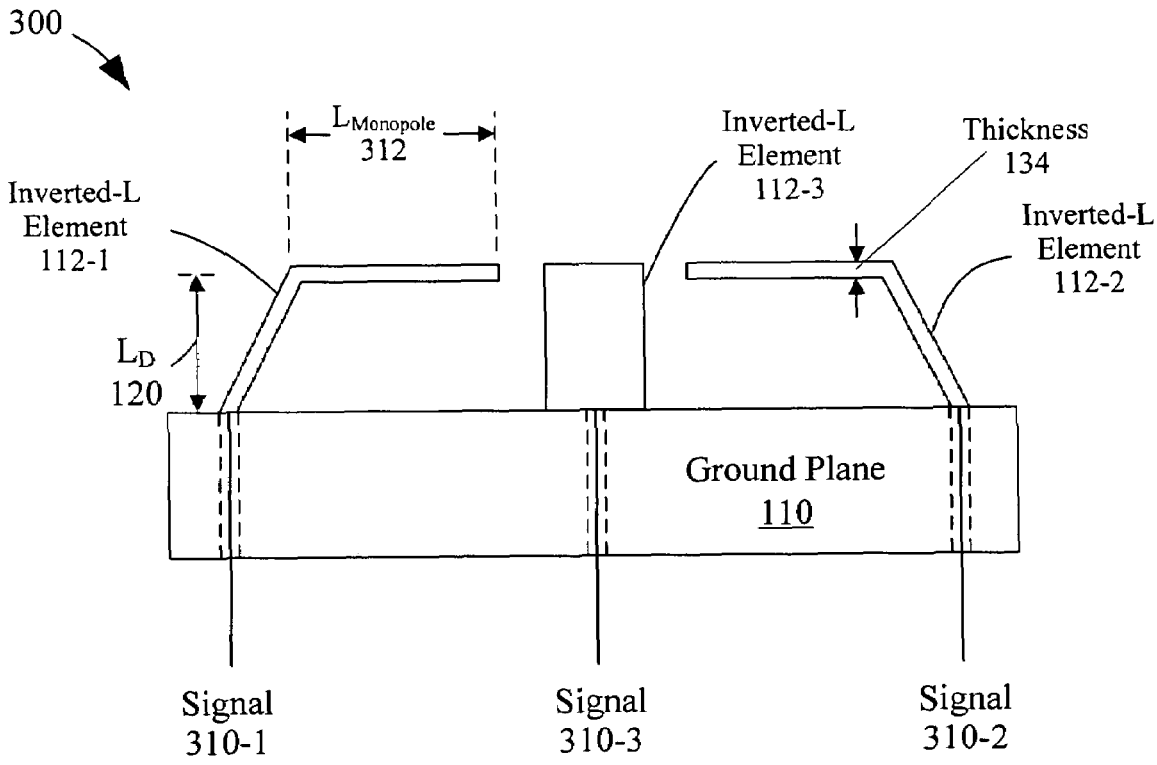
FIG. 3A is a block diagram illustrating a side view of an embodiment of a multi-band antenna.
Figure 3B:
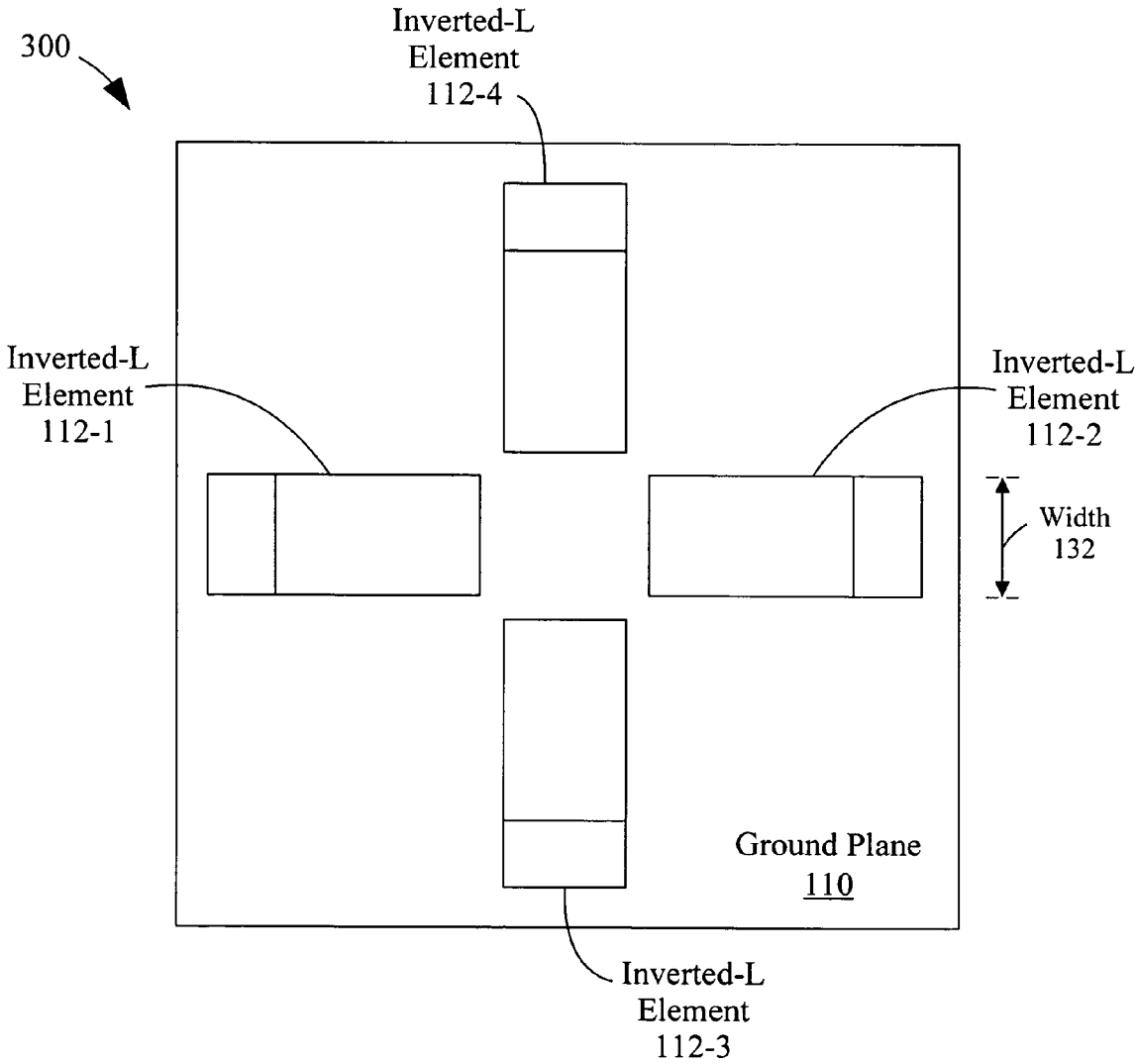
FIG. 3B is a block diagram illustrating a top view of an embodiment of a multi-band antenna.

In other embodiments, the antenna 200 or the antenna 100 (FIGS. 1A and 1B) may include additional inverted-L elements. This is shown in FIGS. 3A and 3B, which are block diagrams illustrating an embodiment of a multi-band antenna 300 having four inverted-L elements 112-1 through 112-4. While not shown, there are also embodiments with four inverted-L elements corresponding to the inverted-L element geometry in antenna 200 (FIGS. 2A and 2B) or antenna 250 (FIGS. 2C and 2D). Inverted-L elements 112-1 and 112-2 are arranged approximately along the first axis of the antenna 300. Inverted-L elements 112-3 and 112-4 are arranged approximately along a second axis of the antenna 300. The second axis may be rotated by approximately 90° with respect to the first axis.

The antenna 300 does not include respective tank circuits, such as the tank circuits 124 (FIG. 2), in each of the inverted-L elements 112. In some embodiments, however, each of the inverted-L elements 112 of the antenna 300 includes a respective tank circuit (not shown), separating first and second segments of each respective inverted-L element 112. The tank circuits perform a function similar to the tank circuits 124 (FIGS. 1A and 1B) described above.

In some embodiments, the antenna 300 may include additional components or fewer components. Functions of two or more components may be combined. Positions of one or more components may be modified.

Figure 4:
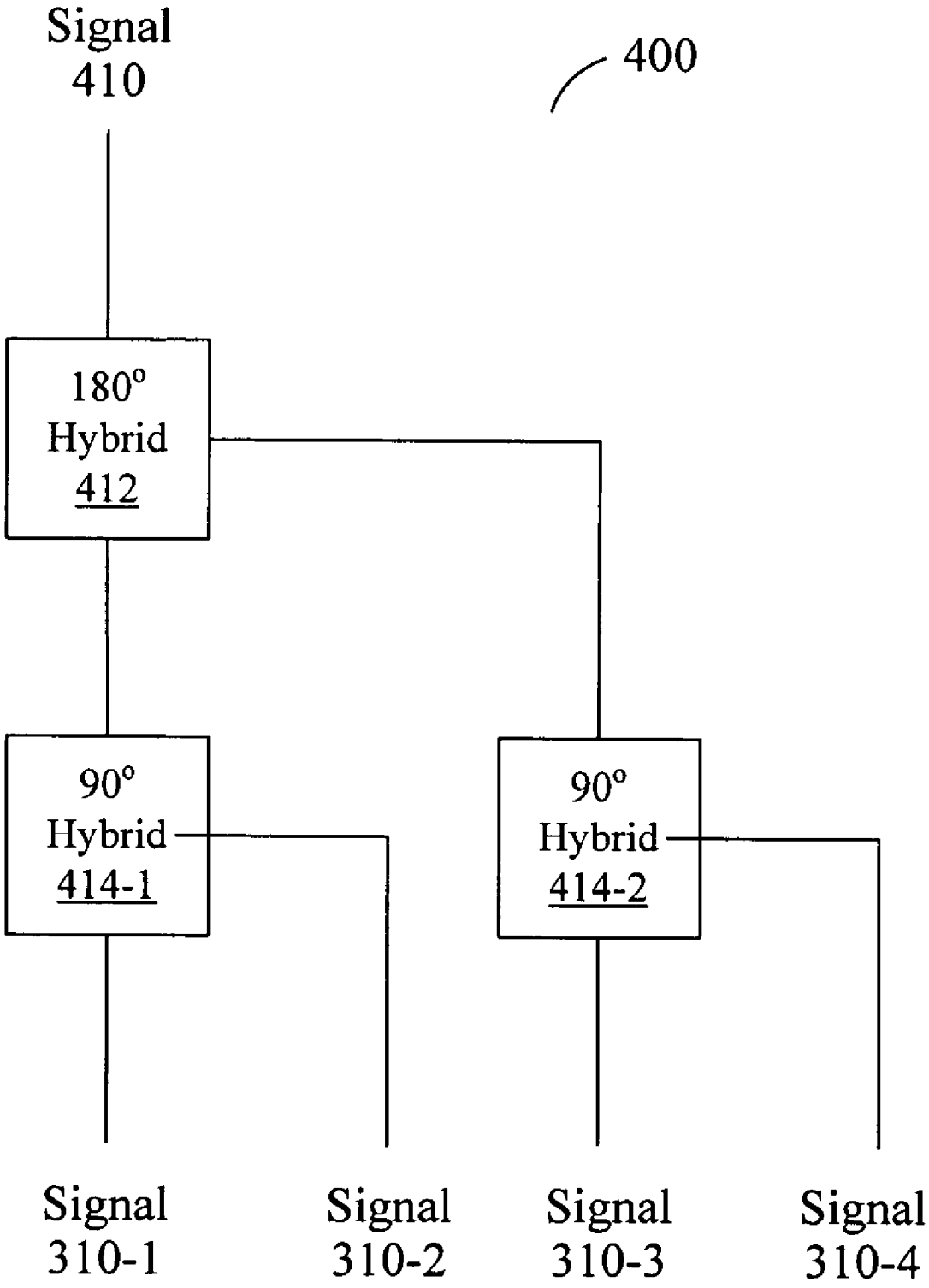
FIG. 4 is a block diagram illustrating an embodiment of a feed network circuit.

As illustrated in FIG. 4, a feed network circuit 400 may be coupled to the antenna 300 (FIGS. 3A and 3B) to provide appropriately phased electrical signals 310 to the inverted-L elements 112. A 180° hybrid circuit 412 accepts an input electrical signal 410 and outputs two electrical signals that are approximately 180° out of phase with respect to one another. Each of these electrical signals is coupled to one of the 90° hybrid circuits 414. The 90° hybrid circuits 414 output the electrical signals 310. A respective electrical signal, such as electrical signal 310-1, may therefore have a phase shift of approximately 90° with respect to adjacent electrical signals 310. In this configuration, the feed network circuit 400 is referred to as a quadrature feed network. The phase configuration of the electrical signals 310 results the antenna 300 (FIGS. 3A and 3B) having a circularly polarized radiation pattern. The radiation may be right hand circularly polarized (RHCP) or left hand circularly polarized (LHCP). Note that the closer the relative phase shifts of the electrical signals 310 are to 90° and the more evenly the amplitudes of the electrical signals 310 match each other, the better the axial ratio of the antenna 300 (FIGS. 3A and 3B) will be.

In some embodiments, the feed network circuit 400 may include additional components or fewer components. Functions of two or more components may be combined. Positions of one or more components may be modified.

Attention is now directed towards illustrative embodiments of the multi-band antenna and phase relationships that occur in the at least two frequency bands of interest. While the discussion focuses on the antenna 300 (FIGS. 3A and 3B), it should be understood that the approach may be applied to other antenna embodiments.

Referring to FIGS. 3A and 3B, the geometry of the inverted-L elements 112 may be determined based on a wavelength $\lambda$ (in vacuum) corresponding to the first band of frequencies, such as a central frequency $f_1$ of the first band of frequencies. (The wavelength $\lambda$ of the central frequency $f_1$ is equal to $c/f_1$, where c is the speed of light in vacuum.) In some embodiments, the inverted-L elements 112 and/or 212 are supported by printed circuit boards that are perpendicular to the ground plane 110. For example, the inverted L-elements 112 and/or 212 may be deposited on printed circuit boards that are mounted perpendicular to the ground plane 110, thereby implementing the geometry illustrated in FIGS. 1-3. In an exemplary embodiment, the printed circuit board material is 0.03 inch thick Rogers 4003, which is a printed circuit board material suitable for microwave applications (it has a low loss characteristic and its dielectric constant $\epsilon$ of 3.38 is very consistent). Using FIGS. 2A-2D as an illustration, the length $L_D$ 220 is 0.08$\lambda$, the length $L_C$ 218 is 0.096$\lambda$, a length $L_B$ 260 is 0.152$\lambda$, the width 224 is 0.024$\lambda$, and the thickness 222 is 0.017 mm. For example, if the central frequency $f_1$ is 1200 MHz, the length $L_D$ 120 is approximately 20 mm, the length $L_C$ 118 is approximately 24 mm, a monopole length $L_{Monopole}$ 312 is approximately 38 mm, $L_C$ 118 is approximately 24 mm, and the width 224 is approximately 6 mm. (Note that $L_{Monopole}$ 312 equals $L_A+L_B$, since $L_E$ equals zero in the embodiment 300.) In this exemplary embodiment, a central frequency $f_2$ in the second band of frequencies is approximately 5/4 (or somewhat more precisely 1.293) times a central frequency $f_1$ in the first band of frequencies. $L_{Monopole}$ 312 for the central frequency $f_2$ (about 1552 MHz) of the second band of frequencies is approximately 29 mm. Therefore the first segment 126 of the inverted-L elements 112 should be about 29 mm long, and the second segment 127 should be about 9 mm long.

In embodiments where the inverted L-elements are supported by printed circuit boards, the geometry of the inverted-L elements 112 and/or 212 are a function of the dielectric constant of the printed circuit board or substrate. Using FIGS. 2C and 2D as an illustrative example, for an antenna that operates at these frequencies and has a 0.03 inch thick substrate with a dielectric constant $\epsilon$, $L_B$ 260, the length $L_D$ 220 and the width 224 can be expressed more generally as $$L_B=0.152\lambda(-0.015756\epsilon+1.053256)$$

$$L_D=0.08\lambda(-0.015756\epsilon+1.053256)$$

and $$\text{Width}=0.024\lambda(-0.015756\epsilon+1.053256).$$

If a substrate with a lower dielectric constant $\epsilon$ is used, the lengths of the inverted-L elements 112 and/or 212 will be larger for a given central frequency $f_1$. Note that $L_C$ is approximately independent of $\epsilon$.

Figure 5:
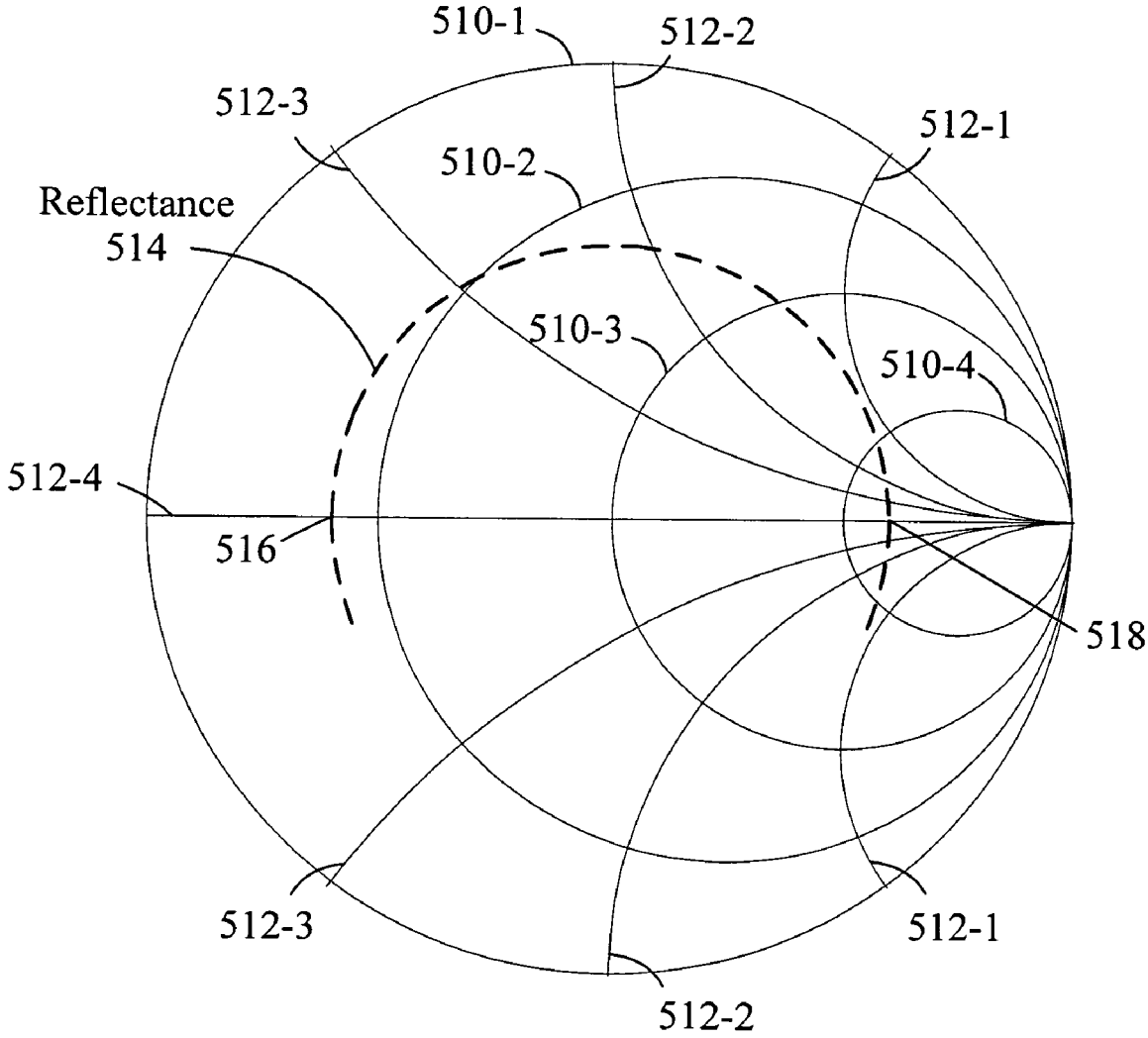
FIG. 5 shows simulated complex reflectance in polar coordinates as a function of frequency for an embodiment of a multi-band antenna.

The geometry of the antenna 300 has advantageous properties. This is illustrated in FIG. 5, which shows the simulated complex reflectance 514 of an inverted-L element (which is related to the impedance), such as the inverted-L element 112-1, in polar coordinates as a function of frequency in what is referred to as a Smith chart. The complex reflectance 514 is referenced to the bottom of the inverted-L element 112-1, just above the ground plane 110. In the Smith chart, circles 510 denote constant resistance and arcs 512 denote constant reactance. Horizontal line 512-4 corresponds to real impedance values, i.e., resistance values with zero reactive component. The far left edge of the horizontal line 512-4 represents 0 Ω and the far right represents ∞ Ω (infinite resistance). Zero crossing 516 corresponds to the central frequency $f_1$ in the first band of frequencies. Zero crossing 518 corresponds to the central frequency $f_2$ in the second band of frequencies. In an exemplary embodiment, the zero crossing 516 is at a frequency of 1200 MHz with an impedance of 12.5 Ω, and the zero crossing 518 is at a frequency of 1552 MHz with an impedance of 200 Ω. If the inverted-L element 112-1 were, instead, to have an impedance of approximately 50 Ω in the first band of frequencies and the second band of frequencies, there would be approximately zero reflectance along the signal lines that couple the electrical signals 310 to the antenna 300 (FIGS. 3A and 3B). Given the phase relationships illustrated in the Smith chart, this may be accomplished by performing an impedance transformation.

Figure 6:
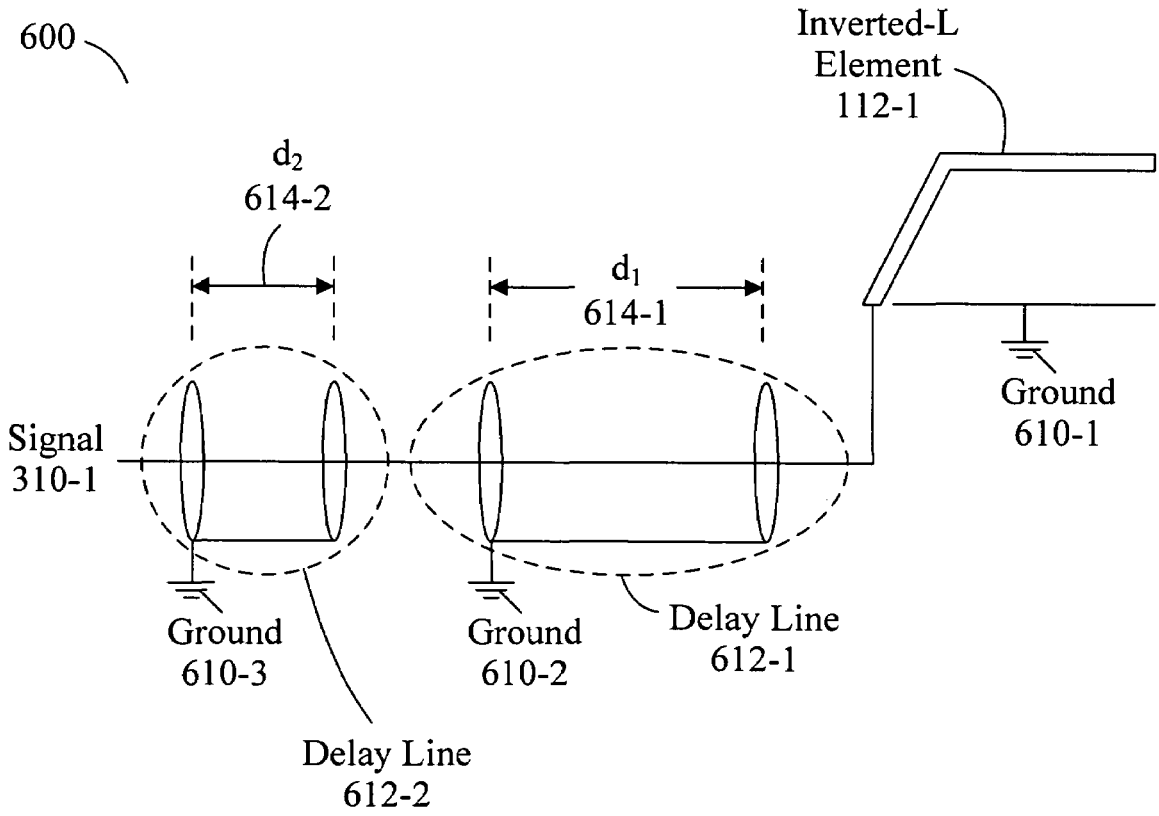
FIG. 6 is a block diagram illustrating an embodiment of an antenna element.

FIG. 6 illustrates an embodiment 600 including the inverted-L element 112-1, ground 410 and two delay lines 612 connected in series to implement an impedance transformation network. The delay lines 612 apply different phase shifts to the electrical signal 310-1 at different frequencies. In particular, delay line 612-1 has a length $d_1$ 614-1 and delay line 612-2 has a length $d_2$ 614-2. The length $d_1$ 614-1 is chosen such that it corresponds to a phase shift of approximately 360° at the central frequency $f_1$ and a phase shift of approximately 540° (360°+180°) at the central frequency $f_2$. In this way, the impedance of the inverted-L element 112-1 in the first and the second band of frequencies will be approximately the same (i.e., the impedance at the central frequency $f_1$).

The length $d_2$ 614-2 of the second delay line 612-2 is chosen such that it corresponds to a phase shift of 90° (λ/4) at frequencies proximate to the first and the second band of frequencies. For this reason, the second delay line 612-2 may be called a quarter wave line. In addition, the second delay line 612-2 has a characteristic impedance that is equal to, or approximately equal to the geometric mean of the impedance at the central frequency $f_1$ and the desired final impedance of 50 Ω. In this way, the impedance of the inverted-L element 112-1 is transformed to approximately 50 Ω in the first band of frequencies and the second band of frequencies. Similar impedance transformation networks may be applied to the other inverted-L antenna elements 112 in the antenna 100 (FIGS. 1A and 1B), the antenna 200 (FIGS. 2A, 2B), the antenna 250 (FIGS. 2C and 2D) and/or the antenna 300 (FIGS. 3A and 3B).

In an exemplary embodiment, at 1200 MHz a phase shift of 360° corresponds to 0.250 m. At 1552 MHz, a phase shift of 270° corresponds to 0.242 m. These two lengths are within 3% of each other. As a consequence, if the length $d_1$ 614-1 is in the range of 0.242-0.250 m the impedance at 1200 MHz remains approximately unchanged (12.5 Ω) and the impedance at 1552 MHz is phase shifted by an additional 180° resulting in an impedance that is approximately the same as that at 1200 MHz. As a compromise, the length $d_2$ 614-2 corresponds to 1377 MHz (approximately mid-way between 1200 and 1552 MHz). In one embodiment, the characteristic impedance of the quarter wave delay line 612-2 is approximately 25 Ω. This results in an approximate impedance of 50 Ω at the 1200 and 1552 MHz.

In some embodiments, the embodiment 600 may include additional components or fewer components. Functions of two or more components may be combined. Positions of one or more components may be modified. While the embodiment 600 illustrates an impedance transformation applied to two modes of an antenna, in other embodiments similar impedance transformations may be applied to more than two modes of an antenna.

Figure 7:
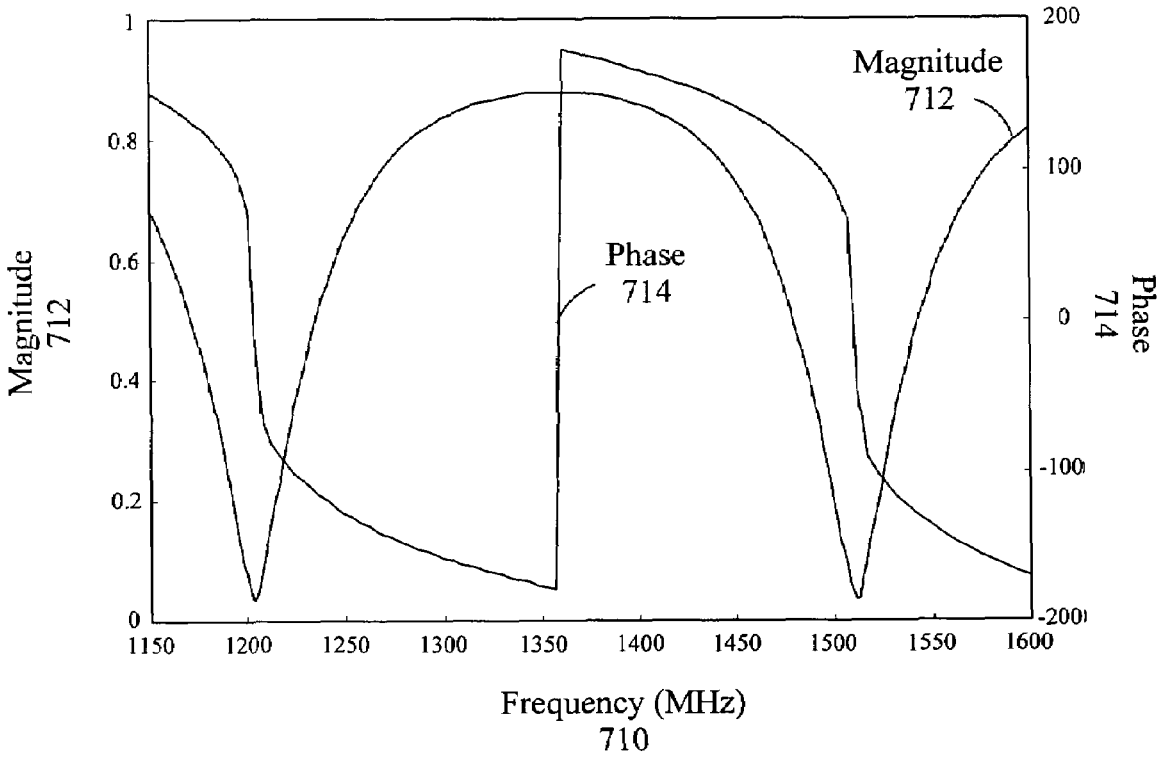
FIG. 7 shows simulated complex reflectance in rectangular coordinates for an embodiment of a multi-band antenna.

FIG. 7 shows simulated complex reflectance, including magnitude 712 and phase 714, in rectangular coordinates as a function of frequency 710, for an embodiment of a multi-band antenna, such as that described above. The antenna, such as the antenna 300 (FIGS. 3A and 3B), exhibits low return loss or good matching (as evidenced by low reflectance magnitude 712) in the vicinity of 1200 and 1552 MHz. As described below with reference to FIG. 8, these frequencies correspond to the center frequencies of the first frequency band and the second frequency band. This indicates that the antenna design is able to support at least dual band operation.

Figure 8:
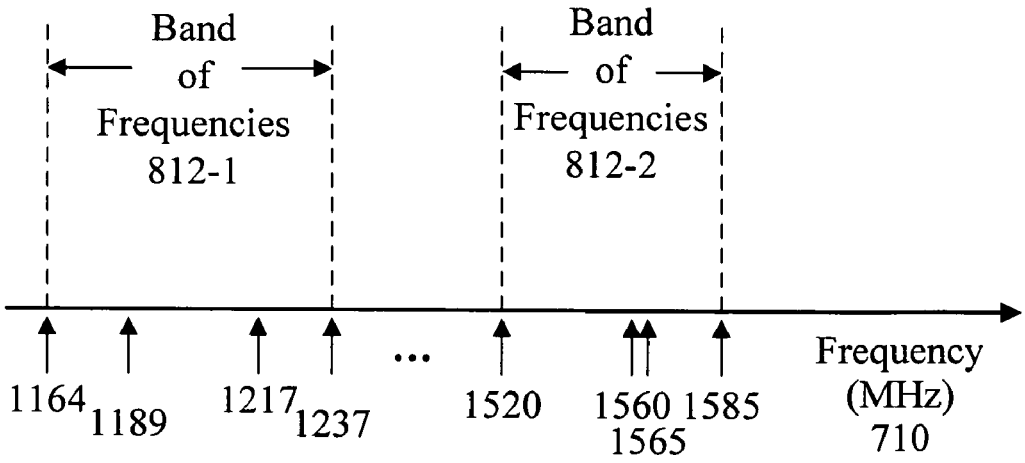
FIG. 8 shows bands of frequencies corresponding to a global satellite navigation system.

FIG. 8 shows bands of frequencies corresponding to a global satellite navigation system, including the L1 band (1565 to 1585 MHz), the L2 band (1217 to 1237 MHz), the L5 band (1164 to 1189 MHz) and L-band communications (1520 to 1560 MHz). In the exemplary embodiment of the multi-band antenna described above, a first band of frequencies 812-1 includes 1164-1237 MHz and a second band of frequencies 812-2 includes 1520-1585 MHz. Note that even though 1200 and 1552 MHz are not precisely equal to the central frequencies of these bands (also called the band center frequencies), they are close enough to the band center frequencies achieve the desired antenna properties. (The center frequencies are actually at 1200.5 MHz and 1552.5 MHz, just 0.5 MHz higher than the nominal values used to design the delay lines 612 in FIG. 6 and tank circuit 124 in FIG. 1A.) In particular, the multi-band antenna has low return loss in the first band of frequencies 812-1 and the second band of frequencies 812-2. In addition, the first band of frequencies 812-1 encompasses the L2 and L5 bands, and the second band of frequencies 812-2 encompasses the L1 band and L-band communications. Thus, a single multi-band antenna is able to transmit and/or receive signals in these four GPS bands.

Figure 9:
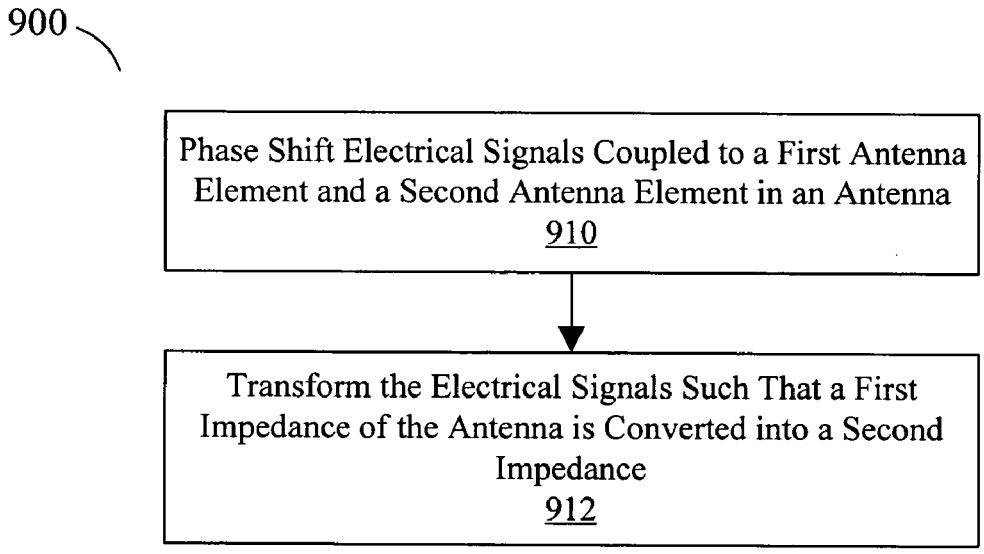
FIG. 9 is a flow chart illustrating an embodiment of a method of using a multi-band antenna.

Attention is now directed towards embodiments of processes of using a multi-band antenna. FIG. 9 is a flow chart illustrating an embodiment 900 of using a multi-band antenna. Electrical signals coupled to a first antenna element and a second antenna element in an antenna are phase shifted (910). The electrical signals are transformed such that a first impedance of the antenna is converted into a second impedance (912).

In some embodiments, the embodiment 900 may include fewer or additional operations. An order of the operations may be changed. At least two operations may be combined into a single operation.

The foregoing description, for purposes of explanation, used specific nomenclature to provide a thorough understanding of the invention. However, it will be apparent to one skilled in the art that the specific details are not required in order to practice the invention. The embodiments were chosen and described in order to best explain the principles of the invention and its practical applications, to thereby enable others skilled in the art to best utilize the invention and various embodiments with various modifications as are suited to the particular use contemplated. Thus, the foregoing disclosure is not intended to be exhaustive or to limit the invention to the precise forms disclosed. Many modifications and variations are possible in view of the above teachings.

It is intended that the scope of the invention be defined by the following claims and their equivalents.

What is claimed:

1. An antenna comprising:

a first antenna element and a second antenna element, wherein the first antenna element and the second antenna element are configured to transmit and receive signals in a first band of frequencies and in a second band of frequencies, and wherein frequencies in the second band of frequencies are greater than frequencies in the first band of frequencies; and a first pair of delay lines coupled to the first antenna element and a second pair of delay lines coupled to the second antenna element, wherein a first delay line in the first pair of delay lines and the second pair of delay lines is configured to phase shift electrical signals coupled to the first antenna element and the second antenna element such that a first impedance of the antenna is approximately equal in the first band of frequencies and the second band of frequencies, and wherein a second delay line in the first pair of delay lines and the second pair of delay lines is configured to convert the first impedance to a second impedance.

2. The antenna of claim 1, wherein the second impedance is substantially 50 Ω.

3. The antenna of claim 1, wherein the first antenna element and the second antenna element each include a monopole situated above a ground plane.

4. The antenna of claim 3, wherein the first antenna and the second antenna are each inverted L-antennas.

5. The antenna of claim 3, wherein the monopole is in a plane that is substantially parallel to a plane that includes the ground plane.

6. The antenna of claim 3 wherein the monopole is in a plane that is substantially perpendicular to a plane that includes the ground plane.

7. The antenna of claim 3, wherein the monopole includes a metal layer deposited on a printed circuit board, and wherein the printed circuit board is suitable for microwave applications.

8. The antenna of claim 1, wherein the first band of frequencies includes 1164 to 1237 MHz and the second band of frequencies includes 1520 to 1585 MHz.

9. The antenna of claim 1, wherein a central frequency in the second band of frequencies is 5/4 times a central frequency in the first band of frequencies.

10. The antenna of claim 1, wherein the second delay line in the first pair of delay lines and the second pair of delay lines has an impedance that is substantially a geometric mean of the first impedance and the second impedance.

11. The antenna of claim 1, wherein the first antenna element and the second antenna element are arranged substantially along a first axis of the antenna.

12. The antenna of claim 1, further comprising:

a third antenna element and a fourth antenna element, wherein the third antenna element and the fourth antenna element are configured to transmit and receive signals in the first band of frequencies and in the second band of frequencies; and a third pair of delay lines coupled to the third antenna element and a fourth pair of delay lines coupled to the fourth antenna element, wherein a third delay line in the third pair of delay lines and the fourth pair of delay lines is configured to phase shift electrical signals coupled to the third antenna element and the fourth antenna element such that the first impedance of the antenna is approximately equal in the first band of frequencies and the second band of frequencies, and wherein a fourth delay line in the third pair of delay lines and the fourth pair of delay lines is configured to convert the first impedance to the second impedance.

13. The antenna of claim 12, wherein the first antenna element and the second antenna element are arranged substantially along a first axis of the antenna, and wherein the third antenna element and the fourth antenna element are arranged substantially along a second axis of the antenna.

14. The antenna of claim 13, wherein the first axis and the second axis are rotated by substantially 90° from one another.

15. The antenna of claim 13, further comprising a feed network circuit coupled to the first antenna element, the second antenna element, the third antenna element and the fourth antenna element, wherein the feed network circuit is configured to phase shift the electrical signals coupled to and from the first antenna element, the second antenna element, the third antenna element and the fourth antenna element such that radiation to or from the antenna is circularly polarized.

16. The antenna of claim 15, wherein the feed network circuit is configured to phase shift the electrical signals coupled to neighboring antenna elements in the antenna by substantially 90°.

17. The antenna of claim 16, wherein the circularly polarized radiation to or from the antenna is right hand circularly polarized.

18. The antenna of claim 12, wherein the third antenna element comprises first and second segments coupled together by a first resonance circuit, and the fourth antenna element comprises third and fourth segments coupled together by a second resonance circuit; wherein the first resonance circuit and the second resonance circuit are configured to each have an impedance greater than a predetermined value in the second band of frequencies such that electrical signals corresponding to the first band of frequencies are coupled to and from the first and second segments of the third antenna element and the third and fourth segments of the fourth antenna element and electrical signals corresponding to the second band of frequencies are substantially coupled to and from the first segment of the third antenna element and the third segment of the fourth antenna element but not the second segment of the third antenna element and the fourth segment of the fourth antenna element.

19. The antenna of claim 1, wherein the first antenna element comprises first and second segments coupled together by a first resonance circuit, and the second antenna element comprises third and fourth segments coupled together by a second resonance circuit; wherein the first resonance circuit and the second resonance circuit are configured to each have an impedance greater than a predetermined value in the second band of frequencies such that electrical signals corresponding to the first band of frequencies are coupled to and from the first and second segments of the first antenna element and the third and fourth segments of the second antenna element and electrical signals corresponding to the second band of frequencies are substantially coupled to and from the first segment of the first antenna element and the third segment of the second antenna element but not the second segment of the first antenna element and the fourth segment of the second antenna element.

20. An antenna comprising:

a first radiation means and a second radiation means for transmitting and receiving signals in a first band of frequencies and in a second band of frequencies, wherein frequencies in the second band of frequencies are greater than frequencies in the first band of frequencies; and a first delay means coupled to the first radiation means and a second delay means coupled to the second radiation means, wherein the first delay means and the second delay means are for phase shifting electrical signals coupled to the first radiation means and the second radiation means such that a first impedance of the antenna is approximately equal in the first band of frequencies and the second band of frequencies, and wherein the first delay means and the second delay means are for converting the first impedance to a second impedance.

21. A method, comprising:

phase shifting electrical signals coupled to a first antenna element and a second antenna element in an antenna, wherein the first antenna element and the second antenna element are configured to transmit and receive signals in a first band of frequencies and in a second band of frequencies, frequencies in the second band of frequencies are greater than frequencies in the first band of frequencies, and wherein a first impedance of the antenna is approximately equal in the first band of frequencies and the second band of frequencies in accordance with the phase shifting; and transforming the electrical signals such that the first impedance is converted into a second impedance.

* * * * *